US007988563B2

(12) United States Patent
Turner

(10) Patent No.: US 7,988,563 B2
(45) **Date of Patent: *Aug. 2, 2011**

(54) GOLF SWING TRAINING APPARATUS

(76) Inventor: William C. Turner, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/610,737

(22) Filed: Nov. 2, 2009

(65) Prior Publication Data

US 2010/0048315 A1 Feb. 25, 2010

Related U.S. Application Data

(63) Continuation-in-part of application No. 12/008,575, filed on Jan. 11, 2008, now Pat. No. 7,611,420.

(51) Int. Cl.
*A63B 69/36* (2006.01)

(52) U.S. Cl. ..... 473/259; 473/257; 473/258

(58) Field of Classification Search ..... 473/219, 473/226, 229, 257, 258, 259, 261, 264, 265
See application file for complete search history.

(56) References Cited

U.S. PATENT DOCUMENTS

| | | | | |
|---|---|---|---|---|
| 1,567,530 | A | 12/1925 | Macnaughton et al. | |
| 1,944,942 | A | 3/1930 | MacDonald | |
| 2,756,056 | A | 3/1954 | Zega | |
| 2,868,543 | A | 1/1959 | Zega | |
| 3,339,927 | A * | 9/1967 | Nunn | 473/258 |
| 3,341,208 | A | 9/1967 | Marcella | |
| 3,489,416 | A | 1/1970 | Mark | |
| 3,583,707 | A | 6/1971 | Fujimoto | |
| 3,711,103 | A | 1/1973 | Seltzer | |
| 4,949,974 | A | 8/1990 | Bellagamba | |
| 5,429,367 | A | 7/1995 | Amos | |
| 5,441,275 | A | 8/1995 | Yoshishita | |
| 5,467,993 | A | 11/1995 | Higginson | |
| 5,595,545 | A | 1/1997 | O'Brien | |
| 5,816,932 | A | 10/1998 | Alexander | |
| 5,895,327 | A | 4/1999 | Francisco | |
| 5,984,798 | A | 11/1999 | Gilmour | |
| 6,273,826 | B1 | 8/2001 | Bauer | |
| 6,364,786 | B1 | 4/2002 | Khano | |
| 7,144,340 | B1 | 12/2006 | Jones et al. | |
| 7,238,116 | B1 | 7/2007 | Sulzener | |
| 2005/0096145 | A1 | 5/2005 | Barretto | |

* cited by examiner

*Primary Examiner* — Nini Legesse
(74) *Attorney, Agent, or Firm* — Charles J. Prescott

(57) ABSTRACT

A golf swing training apparatus including a golf club guide and, preferably, a support frame having spaced apart front and rear frame members connected together by a base frame member. The support frame is adjustably inclined at the lie angle of the golf club by a support arm. The golf club guide includes closely spaced apart front and rear guide ring segments which define a substantially planar circular shaped golf club swing slot therebetween, the swing slot having an unobstructed preferably adjustable width for free swing a golf club therewithin. The front guide ring segment is attached to and is supported by the front frame members while the rear guide ring segment is attached to and is supported by the rear frame member. An economy embodiment is also provided. A substantially flat club shaft guide supportively aligns the golf club shaft at the lie angle of the head.

2 Claims, 15 Drawing Sheets

100
102
120
128
124
102a
110
112
122
102b
106
114

GOLF SWING TRAINING APPARATUS

CROSS-REFERENCE TO RELATED APPLICATIONS

This is a continuation-in-part of application Ser. No. 12/008,575, filed Jan. 11, 2008.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to golf training devices, and more particularly to a golf swing training apparatus which forces the free swing of a golf club into an inclined plane for more proper repetitious swing practice.

2. Description of Related Art

A great deal of inventiveness and productivity has been directed to improving the rather unnatural golf swing of a golfer. Because the golf swing is so unnatural, to achieve a proper and consistent golf swing for more accurate golf play, a golfer must ingrain the mental image and movement of a golf club to fall within an inclined plane generally equal in inclination to the lie of the golf club being used. The only way to accomplish this is by repetitious consistent practice of a proper swing both in backstroke, down stroke and follow-thru.

A number of prior art devices which have been patented which are intended to accomplish this essential learning technique. U.S. Pat. No. 3,711,103 to Seltzer teaches a golf club swing guide including track members for guiding the golf club through a grooved swing, the support being adjustable in inclination. Newly issued U.S. Pat. No. 7,238,116 to Sulzener discloses a golf swing training apparatus with adjustable feet, telescopically adjustable A-frames and a hinged guide ring.

A golf club swing training device is disclosed in U.S. Pat. No. 5,816,932 to Alexander including framework having a forward ring member, the device being adjustable as to elevation and angle of plane. Amos teaches an adjustable golf swing practice device in U.S. Pat. No. 5,429,367 and Yoshishita discloses a golf swing training device being pivotable and having a swing path guide loop in U.S. Pat. No. 5,441,275.

Higginson teaches a golf swing training device including a guide track which is pivotally adjustably mounted on height adjustable side supports in U.S. Pat. No. 5,467,993. A very complicated device complete with sensors and computer microprocessor is disclosed by Gilmour in U.S. Pat. No. 5,984,798.

U.S. Pat. No. 5,895,327 to Francisco discloses a golf swing aid which constrains the swing of a golf club and Khano teaches a golf swing device with the golf club shaft affixed to the guide shaft in U.S. Pat. No. 6,364,786. Bellagamba teaches a golf club swing guide which is adjustable in U.S. Pat. No. 4,949,974 and Bauer discloses a golf swing training apparatus having a club guide ring in U.S. Pat. No. 6,273,826.

Earlier patents teaching golf swing devices include U.S. Pat. No. 1,567,530 to Macnaughton, et al., U.S. Pat. No. 2,868,543 to Zega, U.S. Pat. No. 3,341,208 to Marcella, U.S. Pat. No. 3,583,707 to Fujimoto and U.S. Pat. No. 3,489,416 to Mark.

U.S. Pat. No. 7,144,340 to Jones, et al. teaches a golf swing training device and method of use including a first and second rail with a carriage system slidably attached thereto. O'Brien teaches a golf swing training apparatus having circular track hoop made of light weight metal in U.S. Pat. No. 5,595,545.

The present invention provides a still further improvement in a golf swing training apparatus which controls the inclined planar movement of a golf club during the entire golf swing sequence without the use of a track or mechanical connection with the shaft of the golf club while still insuring that the golf club swing consistently lies within the desired inclined swing plane.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a golf swing training apparatus including a golf club guide and, in one embodiment, a generally U-shaped support frame having spaced apart front and rear frame members connected together by a base frame member. The support frame is adjustably inclined to the ground or a working support surface at the lie angle of the golf club by a support arm. The golf club guide is positioned between the frame members and includes closely spaced apart front and rear guide ring segments which define a substantially planar circular shaped golf club swing slot therebetween, the swing slot having an unobstructed preferably adjustable width adapted for free swing a golf club therewithin. The front guide ring segment is attached to and is supported by the front frame members while the rear guide ring segment is attached to and is supported by the rear frame member. An economy embodiment is also provided. A substantially flat club shaft guide supportively aligns the golf club shaft at the lie angle of the head.

It is therefore an object of this invention to provide a golf swing training apparatus which facilitates repeated consistent golf swing practice to engrain the feel of a proper swing into the memory of a golfer.

Yet another object of this invention is to provide a golf swing training apparatus which is easily adjustable to accommodate the height of the golfer and lie of the head of any particular golf club.

Still another object of this invention is to provide a golf swing training apparatus which guides the swing of the golf club in a desired narrow swing plane without restricting its free swing movement.

Another object of this invention is to provide a golf swing training apparatus with a variable width swing slot which is adjustable in accordance with the skill of the golfer.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 12:
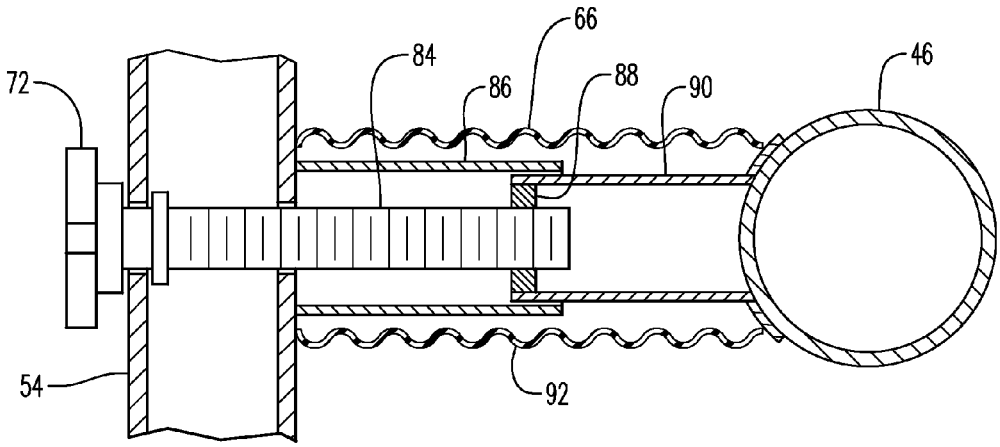
FIG. 12 is a section view in the direction of arrows 12-12 in FIG. 11.
Figure 12A:
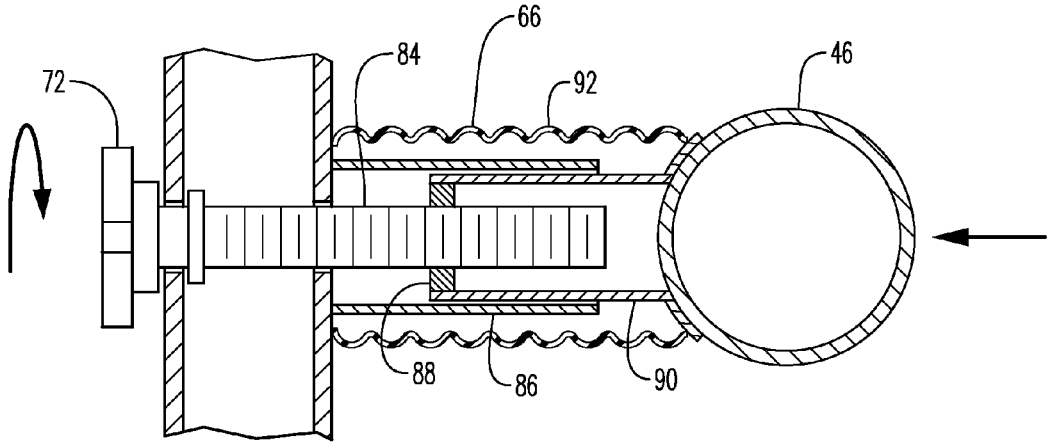

FIG. 12*a* is an alternate view of FIG. 12 showing the adjustable length aspect of each adjusting link of FIG. 12.

Figure 13:
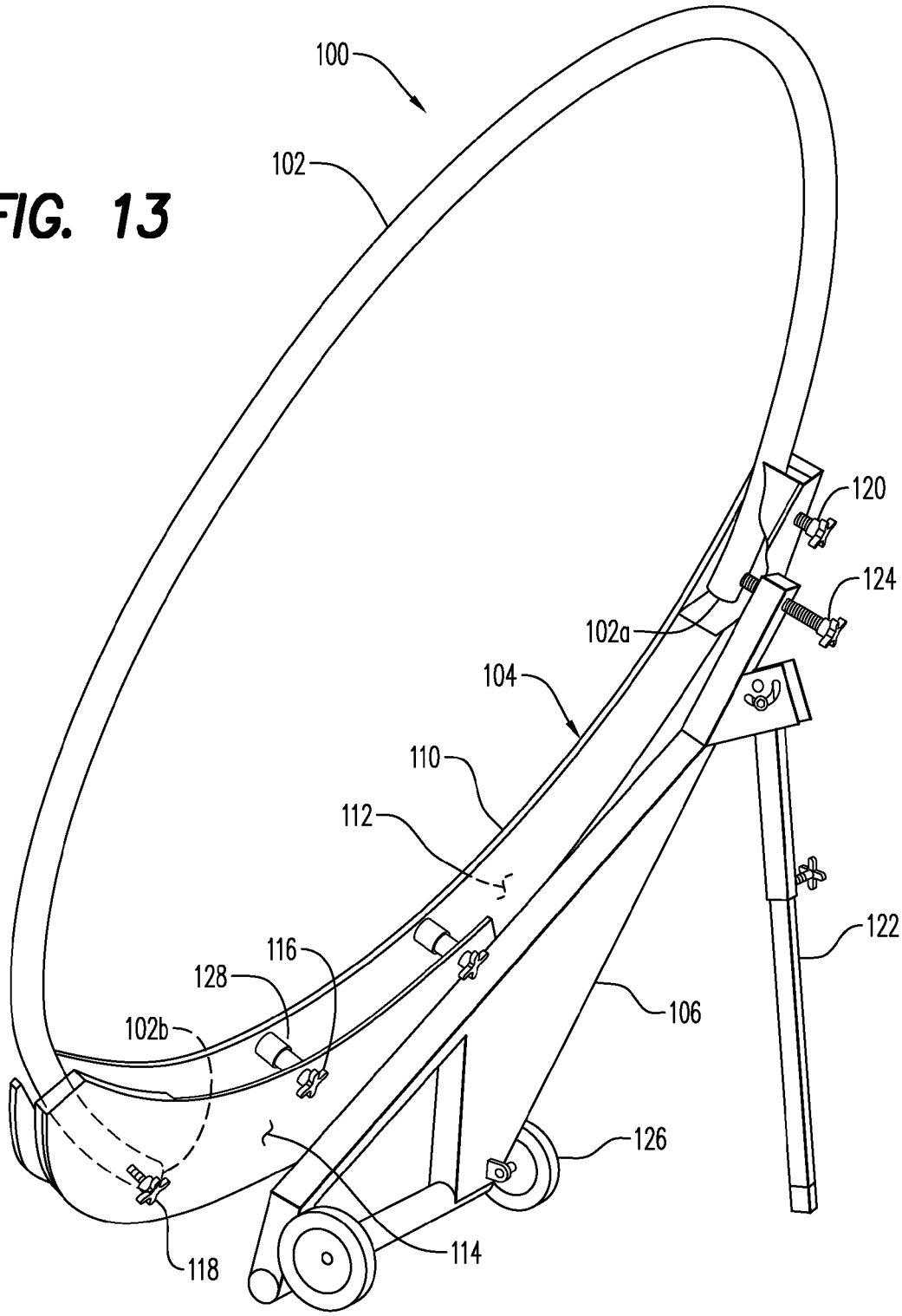

FIG. 13 is a perspective view of still another embodiment of the invention provided for economy.

Figure 14:
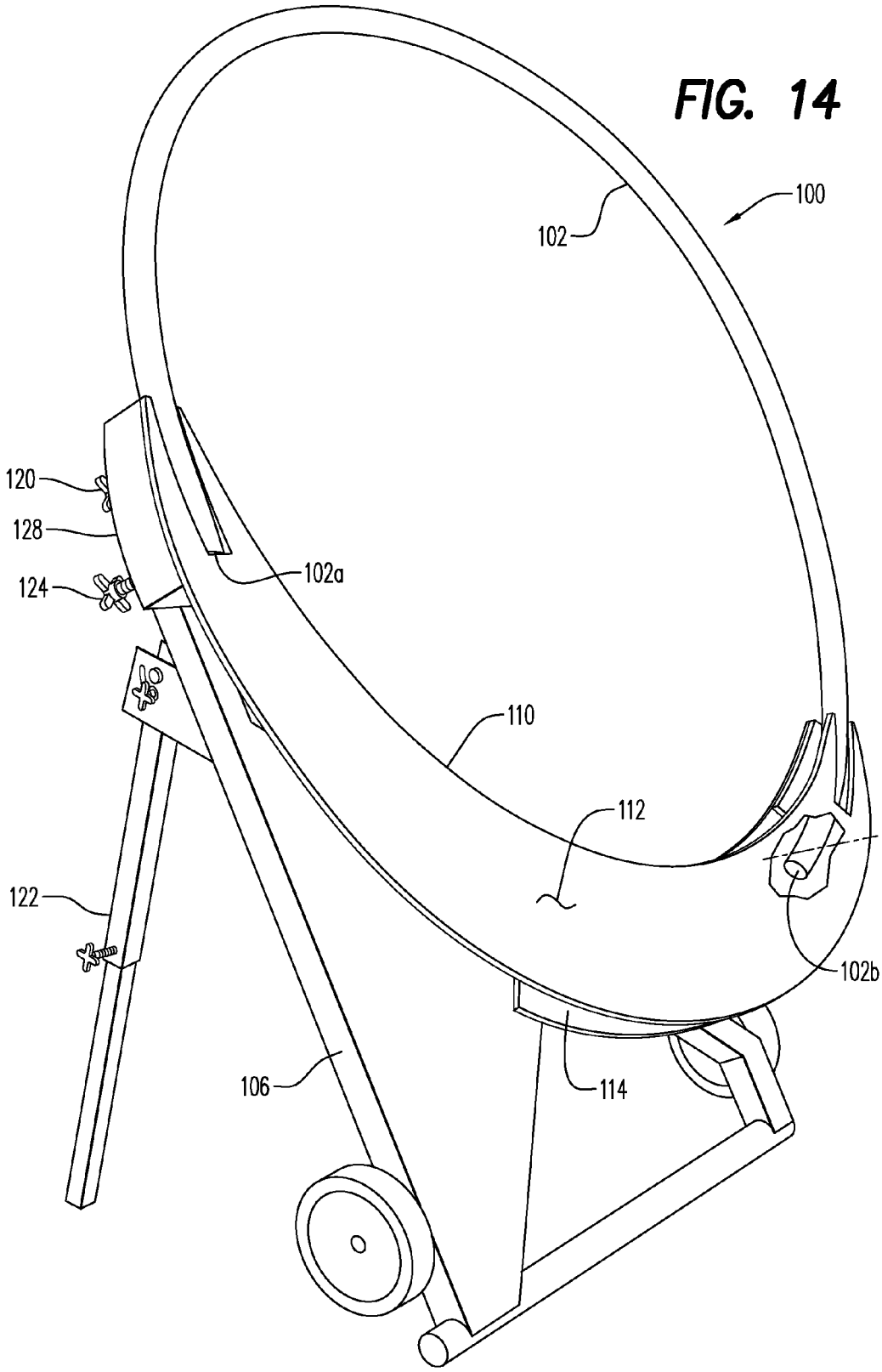

FIG. 14 is another perspective view of FIG. 13.

Exemplary embodiments are illustrated in reference figures of the drawings. It is intended that the embodiments and figures disclosed herein are to be considered to be illustrative rather than limiting.

DETAILED DESCRIPTION OF THE INVENTION

Referring now to the drawings, and firstly to FIGS. 1 to 4, one embodiment of the invention is there shown generally at numeral 10 and includes a golf club guide assembly 12 and a generally U-shaped support frame 14. The golf club guide assembly 12 includes a front guide ring segment 16 and a rear guide ring segment 18, each of which is formed preferably of thin walled 1½" i.d. somewhat flexible PVC tubing. The front guide ring segment 16 is supported on a front frame member 24 of the support frame assembly 14 by a series of front guide ring holders 36 which support and interconnect the front guide ring segment 16. A center support 40 carries the majority of the weight of the golf club guide assembly 12.

Figure 4:
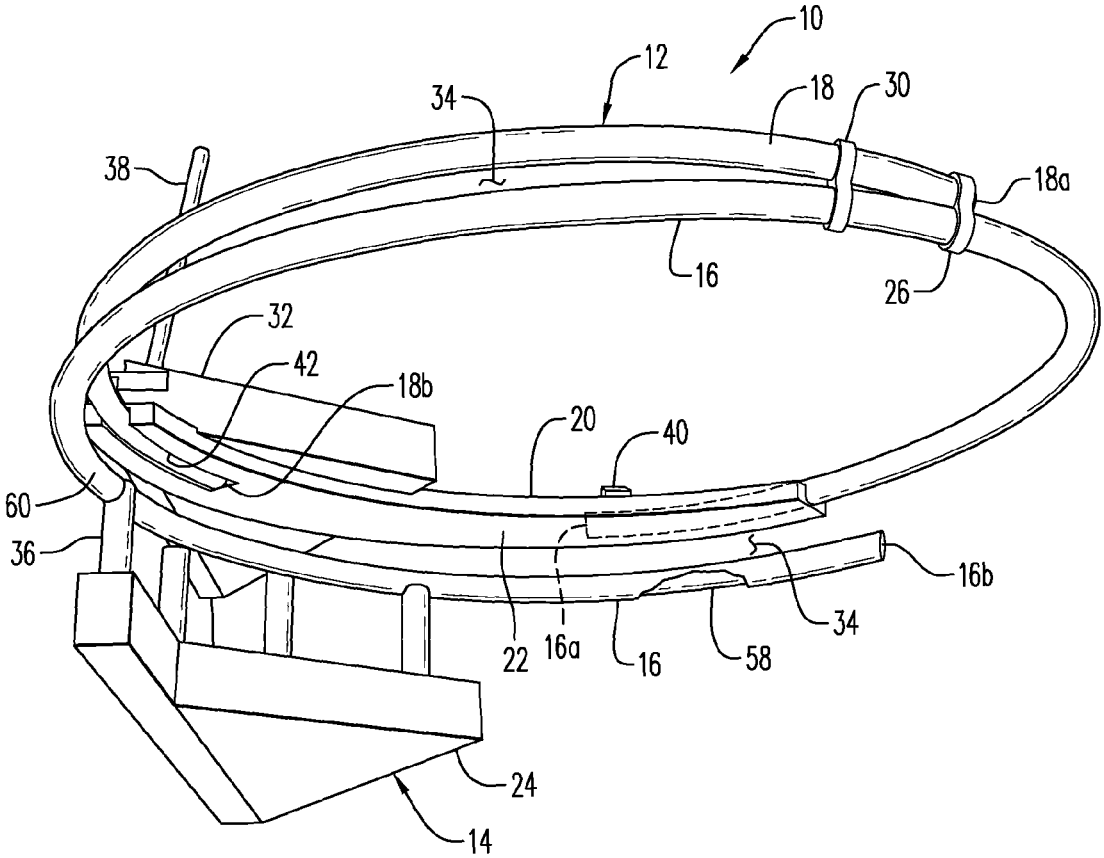
FIG. 4 is an upper perspective view of FIG. 1.

The rear guide ring segment 18 is supported at a proximal end 18*b* within a pocket 42, best seen in FIG. 4, formed into an upper end of a flat, planar club shaft guide 20 which itself is connected to a back frame member 32 of the support frame assembly 14. The front and rear back frame members 24 and 32 are rigidly connected together by a base frame member 28 preferably at an inclined angle so as to establish the plane of the golf shaft guide 20 at an inclined angle D generally equal to the lie angle of the golf club being used. This inclination is described more fully with respect to FIG. 6 herebelow.

Figure 2:
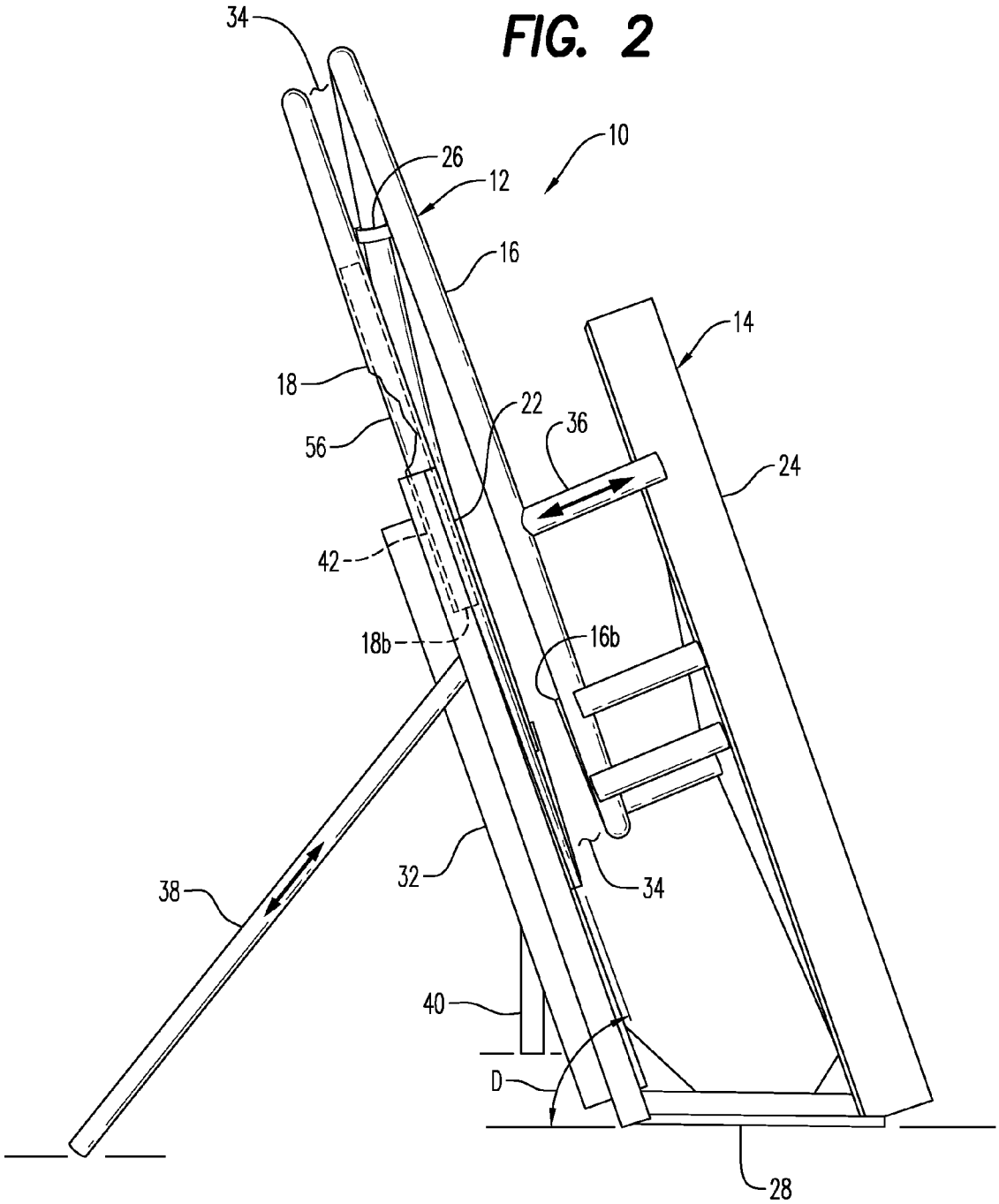
FIG. 2 is a right side elevation view of FIG. 1.

The golf club guide assembly 12 defines an inclined narrow swing slot 34 between the front and rear guide ring segments 16 and 18 as best seen in FIG. 2. This swing slot 34 is adjustable in width by the adjustment of the length of the front guide ring holders 36 while the lie angle D is adjusted for the club selection by varying the length of a support arm 38 connected at an upper end thereof to the back side of the back frame member 32 and bearing against the ground or other support surface at the other end thereof. Thus, the support frame assembly 14 being supported primarily on the base frame member 28 atop the ground or other support surface is tiltable at various inclined angles to establish the angle D of the planar surface 22 of the golf swing guide 20 within a lie angle range of between about 50° and 64°, the typical range of club lie angles commercially available.

The front guide ring segment 16, again primarily being supported by the front guide ring holders 36, extends from its distal end 16*b* through a little more than 360° to be supported within a pocket formed into the lower end portion of the planar club shaft guide 20 terminating at the proximal end 16*a*. The upper distal end 18*a* of the rear guide ring segment 18 is interconnected to the front guide ring segment 16 by a fixed connector 26. Thus, the swing slot 34 extends from a maximum back swing position of a golf club at 18*a* and the fixed connector 26 to the distal end 16*b* of the front guide ring segment 16, the swing slot 34 being completely smooth, clear and unobstructed.

Figure 1:
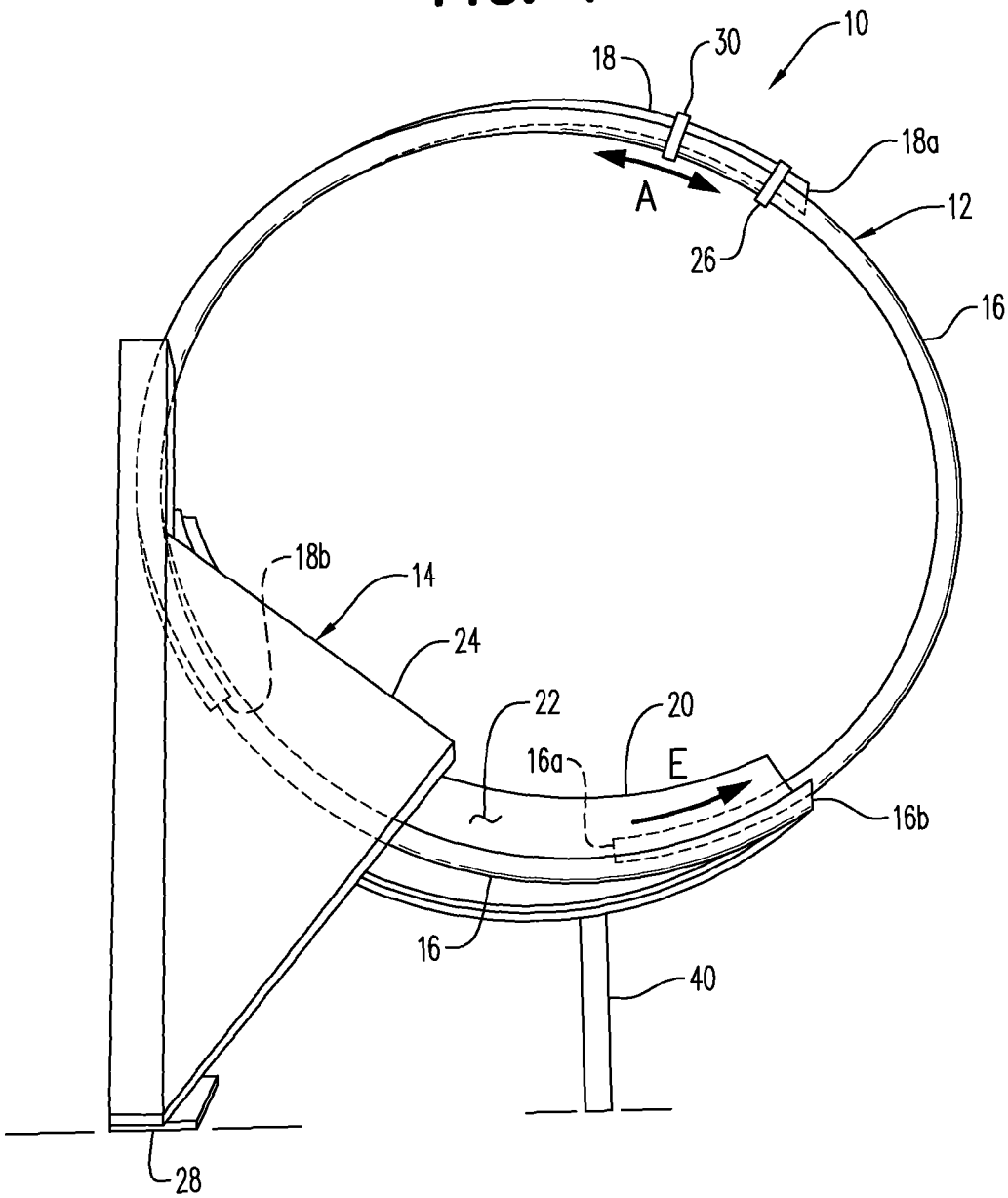
FIG. 1 is a front elevation view of one embodiment of the invention.
Figure 8:
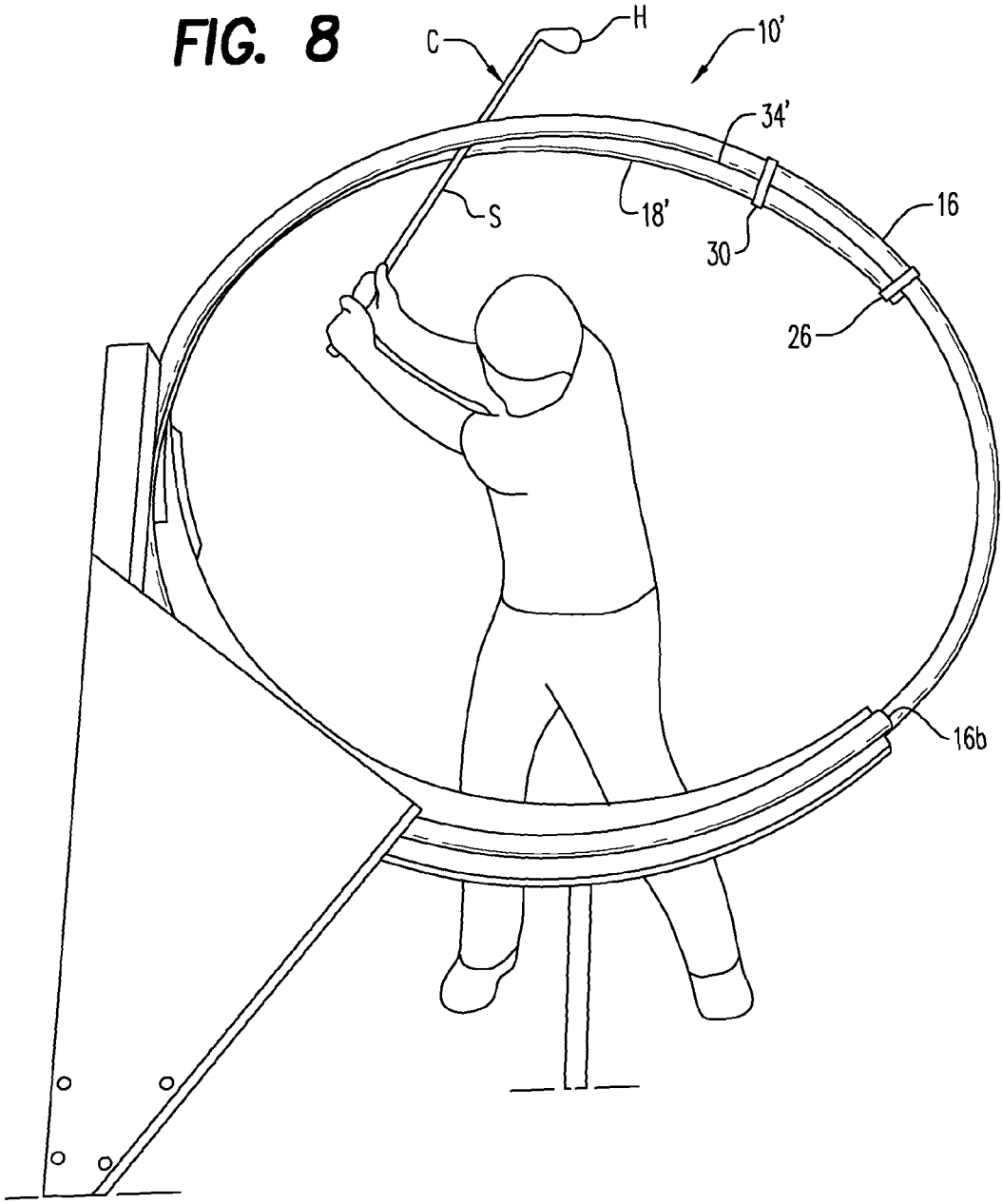
FIG. 8 is another view of FIG. 5 shown during a backstroke of a golf club.

However, the connector 26 is oriented as best seen in FIG. 1 and referencing FIG. 8 at an arcuate point well beyond the end of the normal back swing of a golf club. To allow the golfer to be advised of where he wishes to or actually does terminate the back swing, a frictionally slidable back swing stop 30 is also interconnected between the front and back guide ring segments 16 and 18 and is slidably movable back and forth in the direction of arrow A in FIG. 1. By slidably positioning this back swing stop 30 selectively along and between the front and back guide ring segments 16 and 18, a back swing termination point of the swing slot 34 is established. Thus, during back swing practice, the shaft of the golf club will contact this back swing stop 30 to advise the golfer that the back swing has extended to a desired point and/or to facilitate observing any variation in the extent of movement of the back swing, stop 30 after the practice swing is made. That is, the swing stop 30 may be tightly secured or made frictionally slidable to serve as a back swing stop or as a back swing indicator.

By selecting the material of the front and rear guide ring segments 16 and 18 to be tubular PVC plastic material, and by having established the swing slot 34 to be completely open and unobstructed, only slight contact of the golf club shaft against either of the facing surfaces of the tubular front or rear guide ring segments 16 and 18 is typically made to advise the golfer of the contact and to prevent the golf club from being swung out of the plane established by the narrow swing slot 34. The relatively low drag of the golf club shaft against the PVC material is very slight and does not inhibit in any substantial way the free swing of the golf club within the swing slot 34 while simultaneously preventing the golf club from being swung out of the plane of the swing slot 34.

Figure 5:
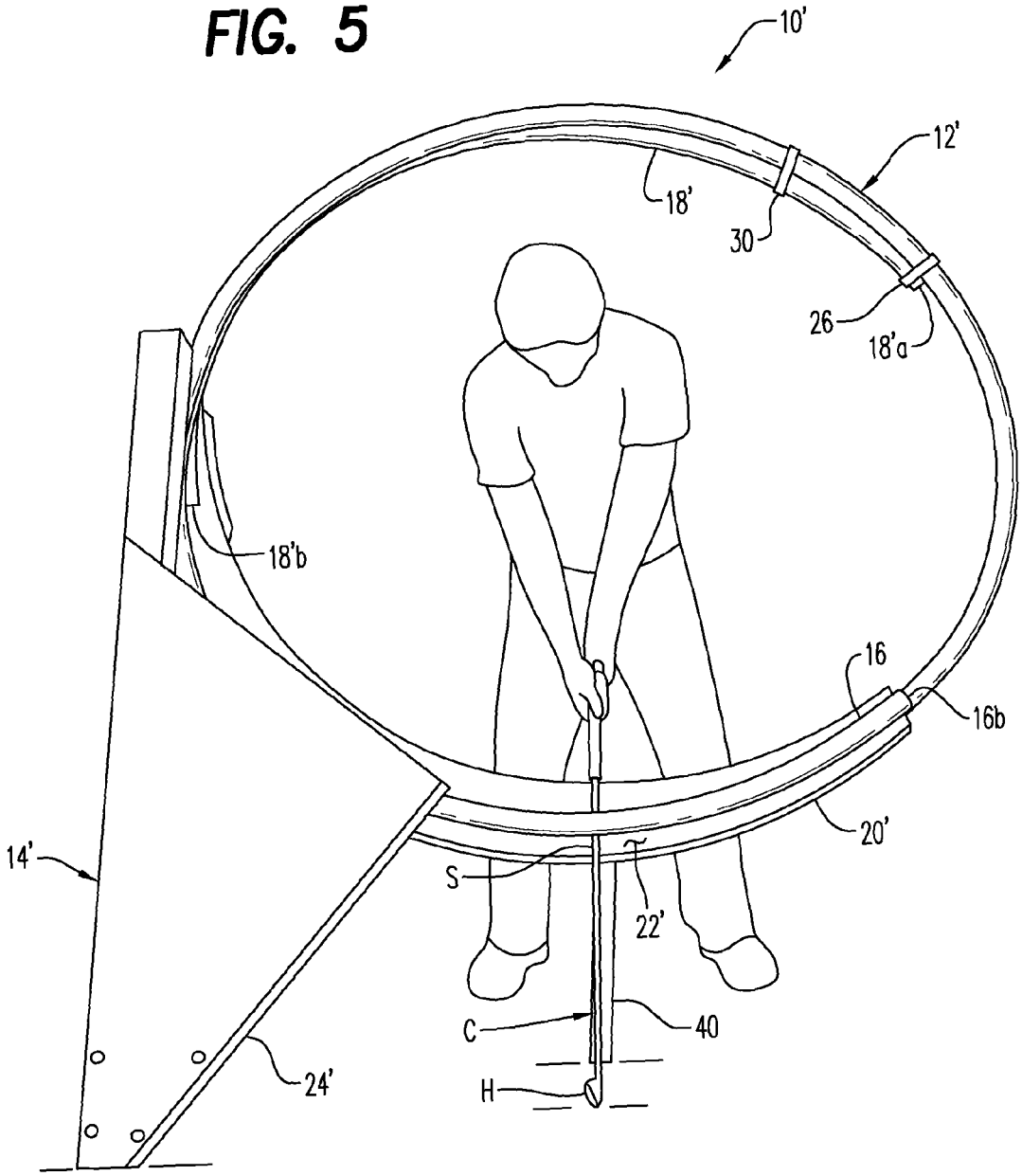
FIG. 5 is a front elevation view of another embodiment of the invention shown in use at the start of a golf swing.

Importantly, note that by embedding the proximal end 18*b* of the rear guide ring segment 18 into the pocket 42 formed into the upper end of the arcuately formed club shaft guide 20, a smooth uninterrupted surface is maintained between the inner surface of the rear guide ring 18 and the planar surface 22 of the club shaft guide 20. Further, by providing the flat or planar inclined surface 22, the shaft of the golf club will rest thereagainst to establish the proper inclined angle which matches the lie of the club being swung. Thereafter, the golfer may then more accurately position himself and his foot stance centrally both fore and aft and laterally within the open area of the golf club guide assembly 12 as shown in FIG. 5.

For taller golfers, the proximal end 16*a* of the front guide ring segment 16 may be slidably adjusted in the direction of arrow E in FIG. 1 so as to enlarge the golf swing guide assembly 12. Frictional engagement within the lower end of the club shaft guide 20 will maintain any selected positioning of the proximal end 16*a*.

Figure 2A:
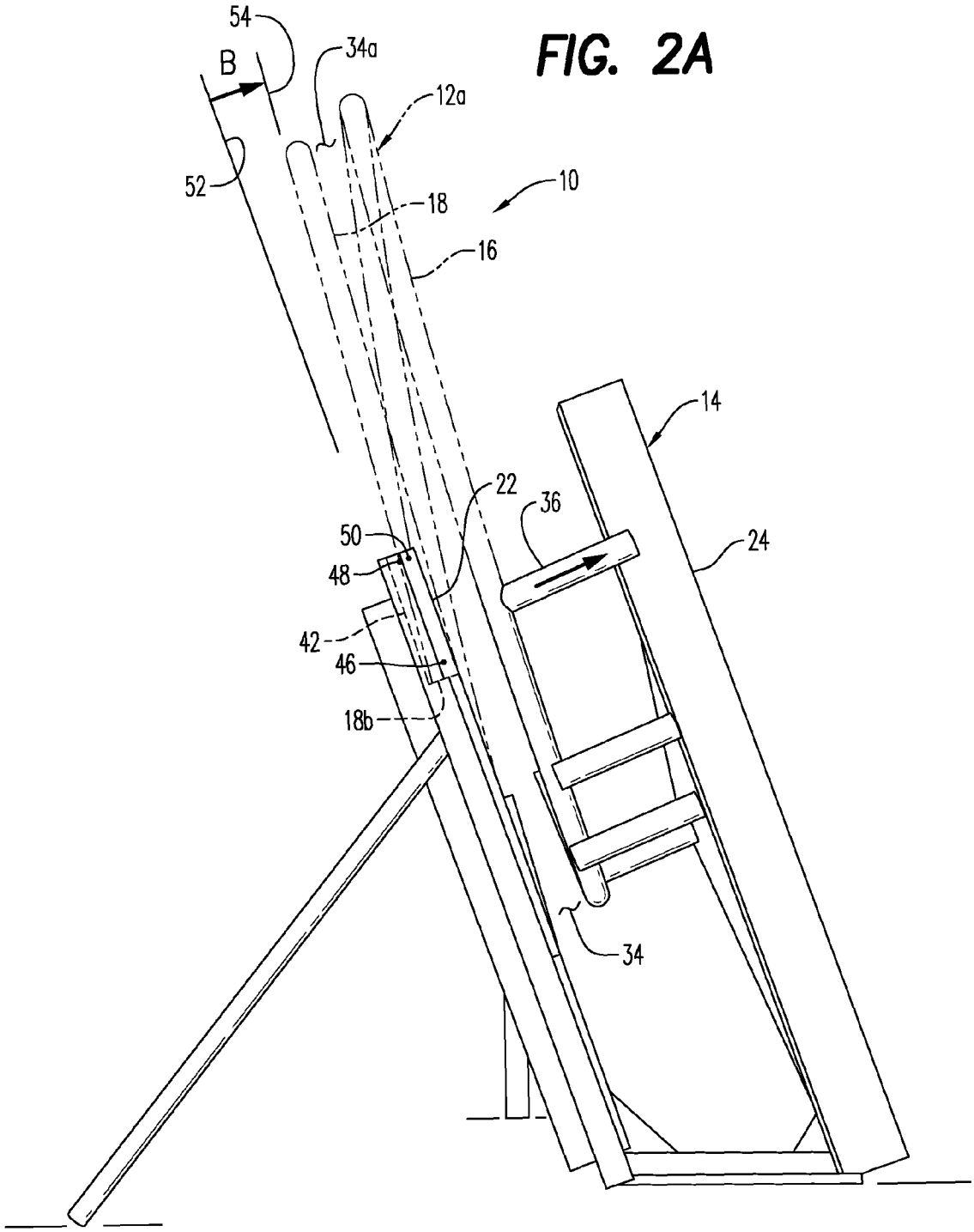
FIG. 2A is a modificating manipulation of the apparatus shown in on of FIG. 2 showing the reorientation of the upper portion of the golf club guide shown in phantom.
Figure 3:
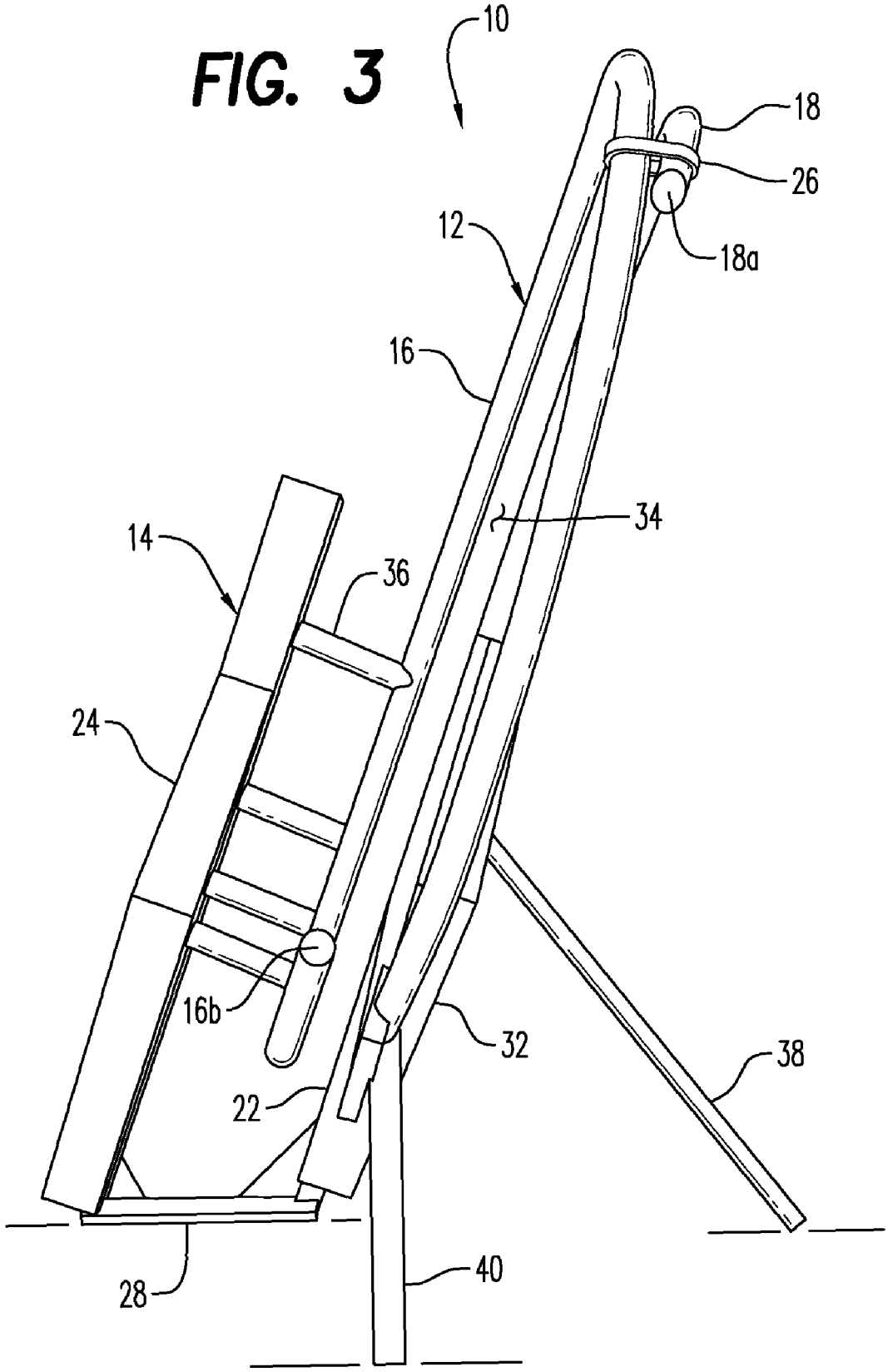
FIG. 3 is a right side elevation view of FIG. 1.

The current level of sophisticated golf swing form has incorporated a golf swing which takes the shape of two separate planar movements, the back swing lying in a plane which is more upright or at a higher lie angle than that of the down swing and follow-thru. Referring to FIG. 2A, the training of this improvement in golf club swing form is accommodated by the forwardly reorientation of the upper portions of the golf club guide assembly 12*a* shown in phantom. This is accomplished by upper pivotal movement of the upper portion of the guide assembly 12*a* and in the direction of arrow B about a lower anchor pin 46 by this repositioning an upper anchor pin 48 to a forwardly anchor pin location at 50. This reestablishes the upper plane of the swing slot 34*a* from plane 52 into a forwardly plane 54 while the lower portion of the golf club swing guide assembly 12 is maintained within plane 52 as accommodated by the flexible nature of the PVC tubing used to form the front and rear guide ring segments 16 and 18.

As shown in FIGS. 2 and 4, short lengths of 1½" o.d. aluminum reinforcing tubing are added at 56 and 58, respectively for strength and form. The tubing 58 extends from 16*b* to 60 while tubing 56 extends as shown in hidden lines within the respective portions of the rear and front guide ring segments 18 and 16.

Referring now to FIGS. 5 to 9, another and preferred embodiment of the invention is there shown generally at numeral 10' and also includes a golf club guide assembly 12' and a support frame assembly 14', both being substantially similar to that previously described. In these figures, a golfer is also shown during various stages of a practice golf swing starting with the positioning of the golf club C such that the shaft S is positioned in the plane of the planar surface 22' of the golf club guide 20 and the swing slot 34'. With the head H of the club C resting atop the ground at the lie angle D of the club C with the shaft S laying flatly against the planar surface 22, the golfer may then properly position the feet centrally both fore and aft and laterally within the opening of the golf club guide assembly 12 as shown.

Figure 6:
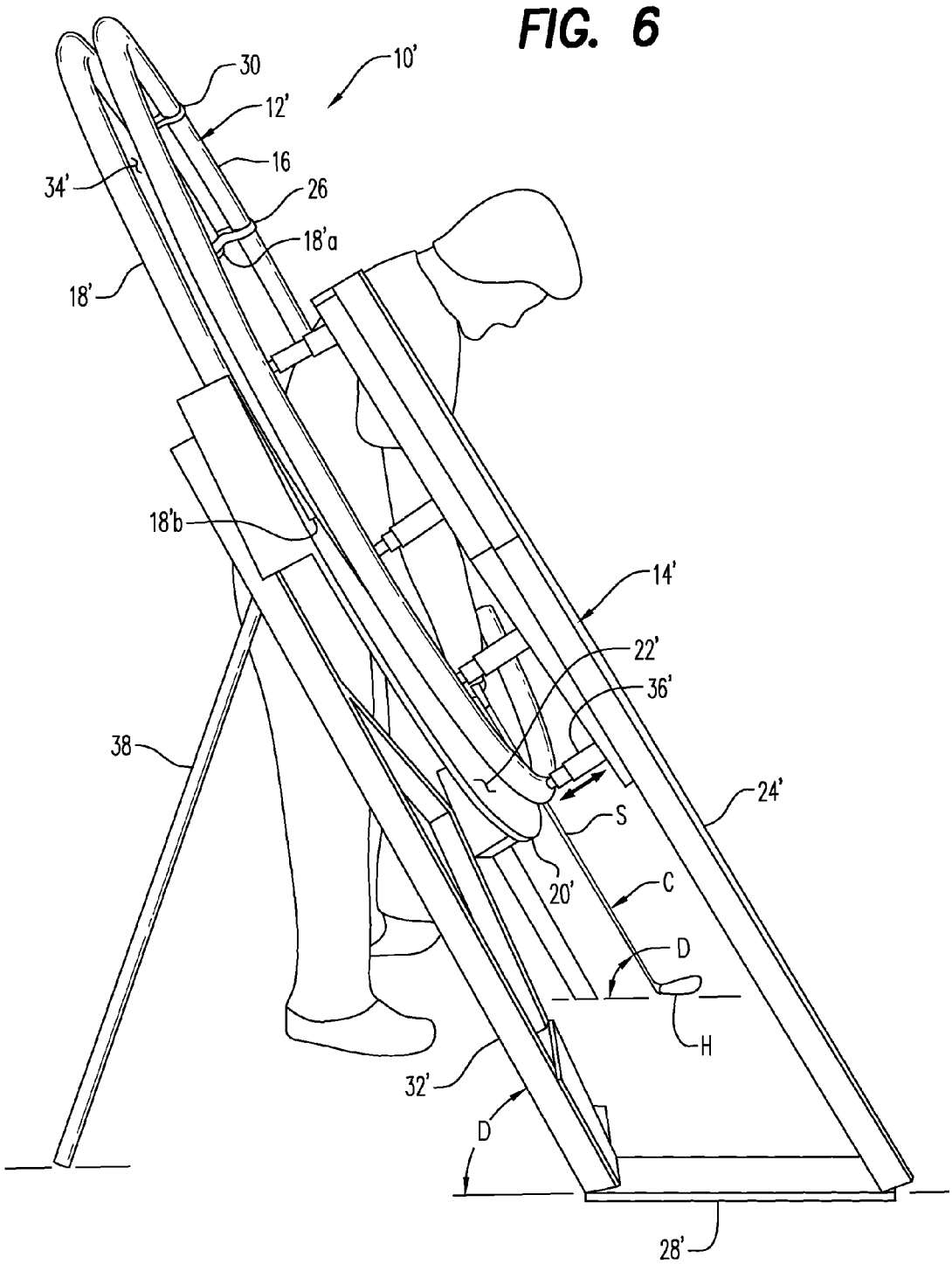
FIG. 6 is a right side elevation view of FIG. 5.
Figure 7:
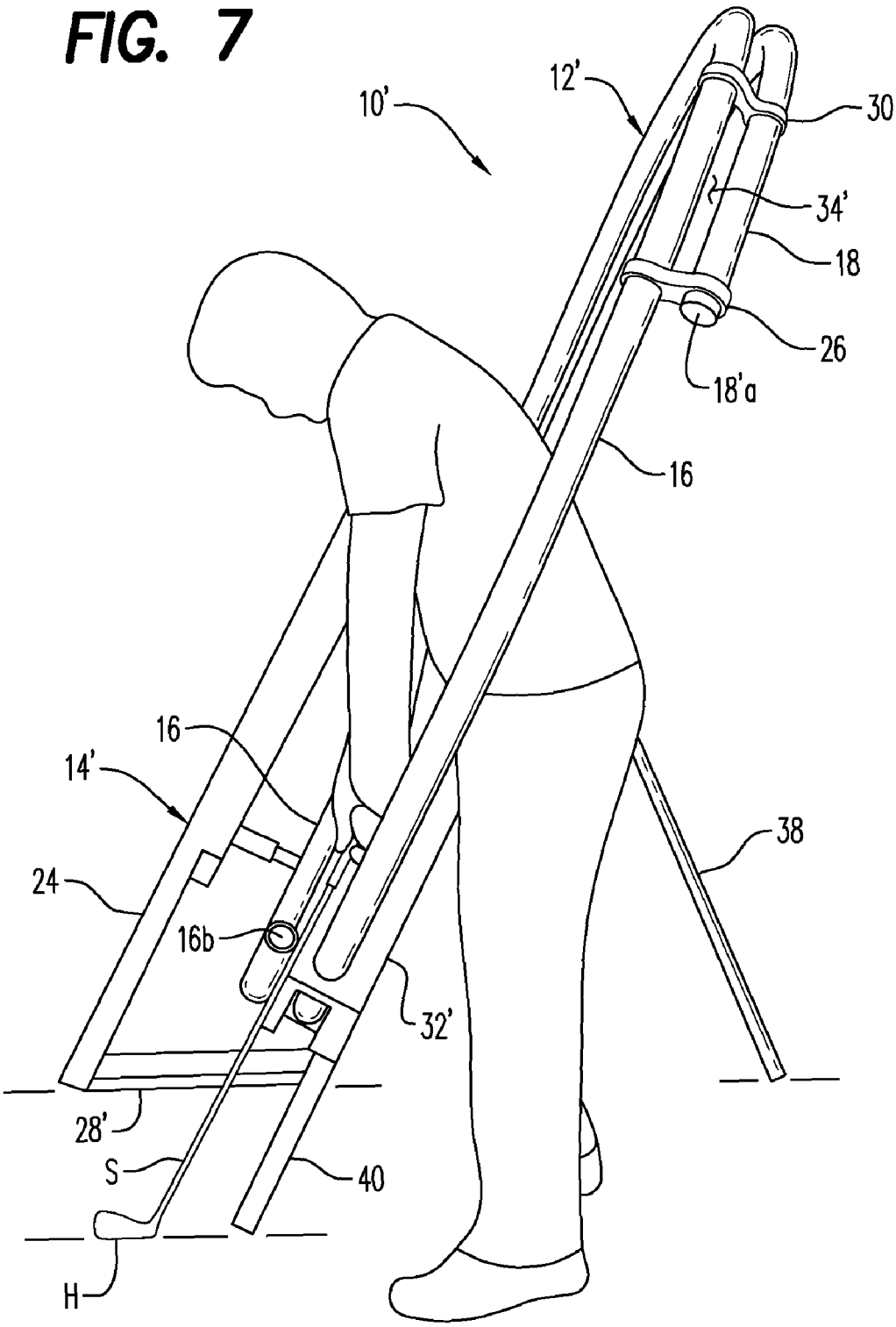
FIG. 7 is a left side elevation view of FIG. 5.

In FIGS. 5, 6 and 7, note that the golf club C is shown centered ready to begin the back swing which extends in FIG. 8 within the golf swing slot 34' up to near the top of the swing slot. Further note that the slidable back swing stop 30 is positioned beyond the end of the back swing and could be moved closer to the top of the golf club guide assembly 12'.

Figure 9:
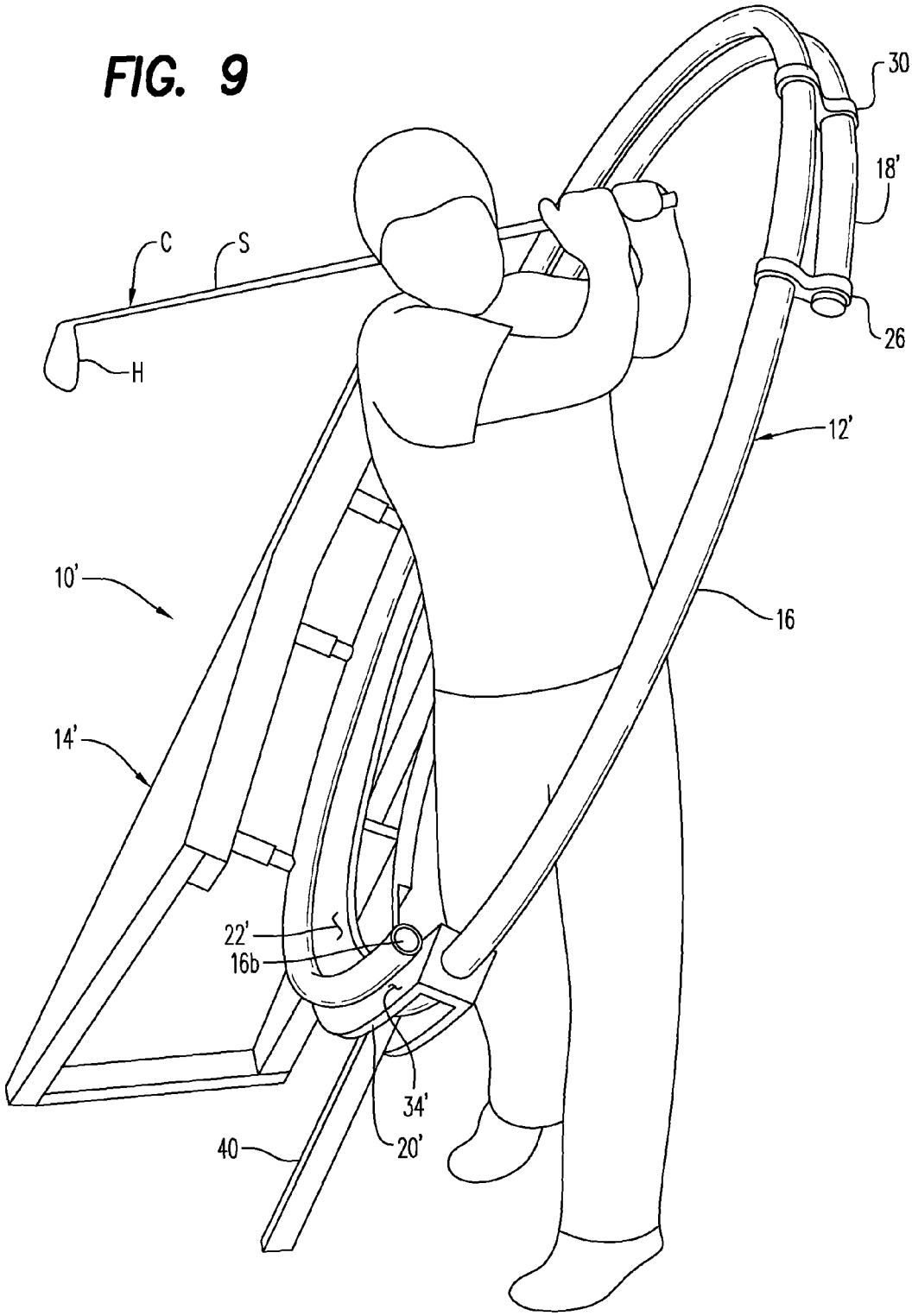
FIG. 9 is a right perspective view of FIG. 5 at the end of a golf club swing.

An important aspect of the invention is shown in FIG. 9 wherein the follow-thru portion of the swing departs from movement within the plane defined by the swing slot 34'. This departure typically begins to occur just beyond the distal end 16*b* of the front guide ring segment 16. Thus, the golf club C is allowed to be freely swung up to the top of the back swing or in proximity to the placement of the back swing stop 30 downwardly through the beginning of the follow-thru portion of the swing at 16*b* or through approximately ⅔ of a full 360° arch. Thereafter, the remainder of the follow thru part of the golf stroke is completely free of guiding interference by the apparatus 10'.

Note that, in this series of figures, the adjustable front guide ring holders 36' have been adjustably extended and locked to narrow the swing slot 34' to accommodate a greater skill of the golfer who has a more consistent uniform swing and is much less likely to make contact with the shaft S of the golf club C with any portion of the golf club guide assembly 12'.

Figure 10:
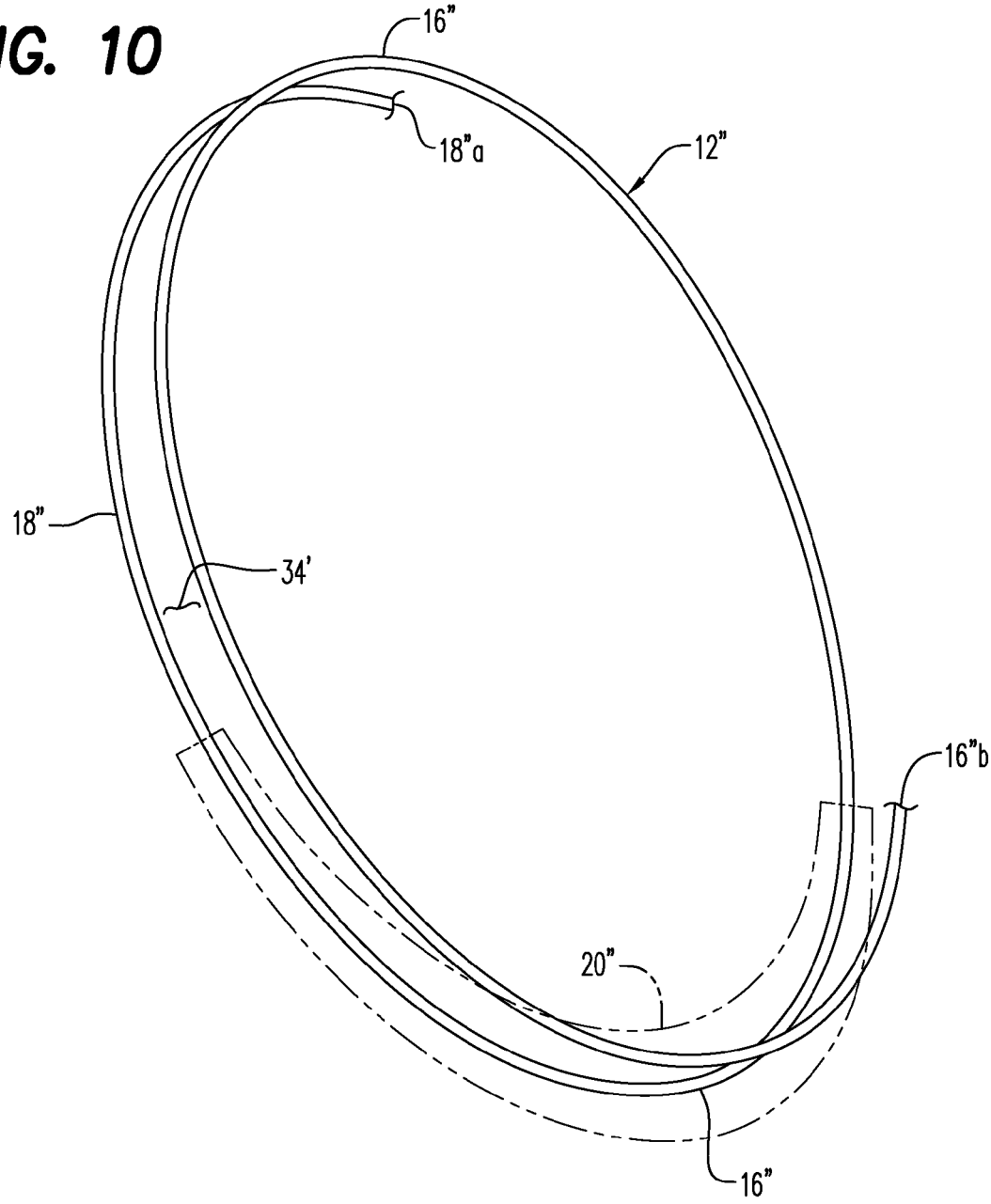
FIG. 10 is a simplistic perspective view of still another embodiment of the invention.

Referring now to FIG. 10, a schematic drawing of a third embodiment of the golf club guide assembly 12" is there shown absent the support frame assembly for clarity. In this embodiment 12", the front and rear guide ring segments 16" and 18" are formed preferably of a single length of 1½" i.d. PVC tubing spiral wound beginning at 16"*b* and terminating at 18"*a*. The flat club shaft guide 20" is incorporated and shown in phantom again for simplicity supporting the lower rear segment of the front guide ring 16". The swing slot 34' is thus formed between the spiral wound golf club guide assembly 12" which is turned through an arcuate angle of approximately 1½ turns or about 430° to 450° to define about 250° to 270° of arcuate length of the swing slot 34'.

Figure 11:
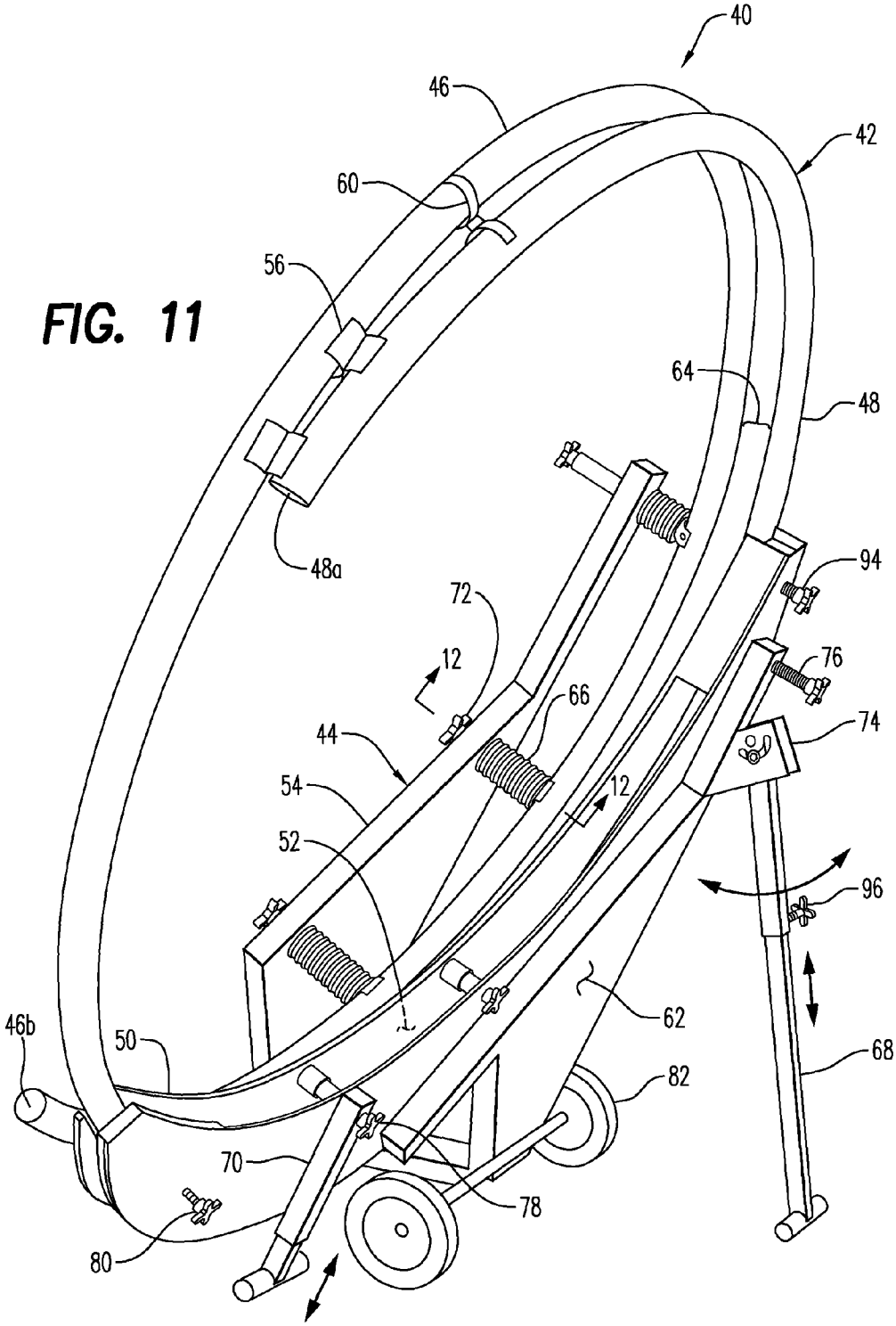
FIG. 11 is a perspective view of another embodiment of the invention.

Referring now to FIGS. 11 and 12, an alternate embodiment of the invention is there shown generally at numeral 40 and is provided to maximize the overall adjustability of a professional-type product which may be incorporated into a golf practice or teaching facility and utilized by a professional golfer or instructor. This apparatus 40 includes a golf guide assembly 42 and a generally U-shaped support frame 44. The golf club guide assembly 42 includes a front guide ring segment 46 and a rear guide ring segment 48, each of which is formed preferably of thin walled 1½" i.d. somewhat flexible PVC tubing. The front ring guide segment 46 is supported on a front frame member 54 of the support frame member 44 by a plurality of adjustable links 66 which support and interconnect the front guide ring segment 46 and the front frame member 54. A center support 68 carries the majority of the golf guide assembly 42.

In this embodiment 42, the front and rear guide ring segments 46 and 48, respectively, are each formed of a single length of 1½" i.d. PVC tubing spiral wound, segment 46 terminating at 46*b*, segment 48 beginning at 48*a*. The flat golf club guide 50 is incorporated supporting one half of the front guide ring 46, the other end of the front guide ring segment 46 being clamped to one end of golf club guide 50 by thumb screw 80. The rear guide ring 48 is supported by rear frame member 62 and the front guide ring segment 46 by fixed connectors 56. The swing slot 64 is thus formed between the front and rear guide ring segments 46 and 48. Thumb screws 76 and 80 provide releasable connection between the rear guide ring segment 48 and the rear frame member 62.

The rear frame member 62 is supported on spaced wheels 82 for easy transportability and is supported at any selected inclination angle support arm 68 and support leg 70, each of which are adjustable in length and secured at any desired length by thumb screws 78 and 96.

The upper distal end 48*a* of the rear guide ring segment 48 is rigidly interconnected to the front guide ring segment 46 by fixed connectors 56 as previously described. A frictionally slidable back swing stop 60 is slidably interconnected between the front and back guide ring segments 46 and 48 to function as previously described.

The front frame member 54 supports the front guide ring segment 46 by a plurality of adjustable links 66 best seen in FIGS. 12 and 12*a*. These links 66 include a thumb screw 72 held for rotation within and transversely to apertures formed into the front frame member 54. An elongated threaded shaft 84 extends through a protective tube 86 attached at one end to the inner surface of the front frame member 54. A support tube 90 attached at one end to the front guide ring segment 46 includes a threaded collar 88 fixed in the distal end of the support tube 90 and which threadably engages with the threaded shaft 84 wherein rotation of the thumb screw 72 causes the adjustability in length of the link 66 causing the front guide ring segment 46 to move in the direction of the arrow (or oppositely) to increase (or decrease) the width of the slot 64 accordingly. A protective expandable plastic boot 92 is provided to keep this mechanism clean and to prevent clothes or other articles from snagging or catching thereon.

Referring now to FIGS. 13 and 14, a simplified embodiment of the invention is there shown generally at numeral 100 and is provided for economy and affordability while still embodying the important aspects of this invention. A single guide ring 102 formed preferably as a segment of a circle of PVC material as previously described extends in a substantially circular, planar configuration from one end thereof 102*a* to the other end thereof 102*b*. End portion 102*a* of the ring guide 102 is supported by support frame 104 between a golf shaft guide 110 and a support block 128 by threaded thumb screw 120. The other end 102*b* is supported between the golf club guide 110 and a secondary support panel 114 by threaded thumb screw 118. The golf club guide 110 and the support panel 114 are interconnected by thumb screws and spacers 128.

As previously described, the golf club guide 110 provides a planar surface 112 to establish and support the shaft of the golf club at the proper lie angle for each particular club with the golf club head resting properly atop the ground. To establish this proper inclination angle of the planar surface 112, the length of the support arm 122 and the adjustability of thumb screw 124 are provided.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A golf swing training apparatus, comprising:

a golf club guide;

a generally U-shaped support frame having spaced apart front and rear frame members connected together by a base frame member, said support frame being inclined to the ground or a working support surface by a support arm;

said golf club guide being positioned between said front and rear frame members and including closely spaced apart front and rear guide ring segments which define a substantially planar circular shaped golf club swing slot therebetween, said swing slot being adjustably positionable by said support arm at an inclined angle substantially equal to a lie angle of a golf club and having an unobstructed width adapted to freely swing the golf club therewithin;

said front guide ring segment being attached to and supported by said front frame members by a plurality of adjusting links, said rear guide ring segment being attached to and supported by said rear frame member;

each link of said plurality of adjusting links being independently adjustable in length to selectively vary the width of said slot by rotation of a thumb screw forming a portion of each of said links;

a substantially flat club shaft guide forming or attached to a lower portion of, and lying in a plane defined by said rear guide ring segment, said club shaft guide being adapted for supporting alignment of a shaft of a golf club at a lie angle of the golf club when the head of the golf club is resting atop the ground or working support surface.

2. A golf swing training apparatus, comprising:

a golf club guide;

a generally U-shaped support frame having spaced apart front and rear frame members connected together by a base frame member, said support frame being adjustably inclined to the ground or a working support surface at an inclined angle equal to the lie of a golf club by a support arm;

said golf club guide being positioned between said front and rear frame members and formed of a spiral-like tubular member forming a guide ring of about 1½ turns to define a substantially planar circular shaped golf club swing slot, said swing slot being unobstructed to freely swing a golf club therewithin;

each link of said plurality of adjusting links being independently adjustable in length to selectively vary the width of said slot by rotation of a thumb screw forming a portion of each of said links;

each of said links including an expandable protective tubular boot substantially coextensive therewith;

a substantially flat club shaft guide forming or attached to a lower portion of, and lying in a plane defined by, a rear segment of said guide ring, said club shaft guide being adapted for supporting alignment of a shaft of a golf club at the lie angle when the head of the golf club is resting atop the ground or working support surface.

* * * * *